United States Patent [19]

Urban

[11] Patent Number: 4,623,357

[45] Date of Patent: Nov. 18, 1986

[54] BLEACH COMPOSITIONS

[75] Inventor: Warren J. Urban, River Vale, N.J.

[73] Assignee: Lever Brothers Company, New York, N.Y.

[21] Appl. No.: 719,085

[22] Filed: Apr. 2, 1985

[51] Int. Cl.[4] ..... C11D 3/39; C11D 7/18

[52] U.S. Cl. ..... 8/107; 252/95; 252/99; 252/186.41; 252/186.27; 252/186.33; 252/186.43; 252/186.3

[58] Field of Search ..... 252/99, 95, 174.13, 252/186.38; 8/107, 109

[56] References Cited

U.S. PATENT DOCUMENTS

| | | | |
|---|---|---|---|
| 2,820,690 | 7/1954 | Feldmann | 8/111 |
| 3,156,654 | 11/1964 | Konecny et al. | 252/95 |
| 3,325,397 | 6/1967 | Plank et al. | 20/120 |
| 3,398,096 | 8/1968 | Das et al. | 252/95 |
| 3,437,599 | 4/1969 | Helmick et al. | 252/186 |
| 3,488,288 | 1/1970 | Hill | 252/99 |
| 3,532,634 | 10/1970 | Woods | 252/95 |
| 3,740,187 | 6/1973 | Kowalski | 8/111 |
| 3,795,625 | 3/1974 | Kowalski | 252/186 |
| 4,207,199 | 6/1980 | Perner et al. | 252/174.13 |
| 4,208,295 | 6/1980 | Sai et al. | 252/94 |
| 4,247,731 | 1/1981 | Wunder et al. | 585/40 |
| 4,307,010 | 12/1981 | Sandler et al. | 260/42.87 |
| 4,478,733 | 10/1984 | Oakes | 252/133 |
| 4,481,129 | 11/1984 | Oakes | 252/186.41 |
| 4,488,980 | 12/1984 | Oakes | 252/99 |
| 4,536,183 | 8/1985 | Namnath | 8/107 |

FOREIGN PATENT DOCUMENTS

| | | |
|---|---|---|
| 25608 | 3/1981 | European Pat. Off. . |
| 70079 | 1/1983 | European Pat. Off. . |
| 72166 | 2/1983 | European Pat. Off. . |
| 82563 | 6/1983 | European Pat. Off. . |

OTHER PUBLICATIONS

Mochida, et al., Transition Metal Ions on Molecular Sieves, Journal of Physical Chemistry, vol. 78, pp. 1653–1657 (1974).

"Transition Metal Ions on Molecular Sieves, II. Catalytic Activities of Transition Metal Ions on Molecular Sieves for the Decomposition of Hydrogen Peroxide", by Mochida et al., J. Phys. Chem. 78, pp. 1653–1657 (1974).

*Primary Examiner*—Paul Lieberman
*Assistant Examiner*—John F. McNally
*Attorney, Agent, or Firm*—Milton L. Honig; James J. Farrell

[57] ABSTRACT

A bleaching composition is provided which comprises a catalyst having a water-soluble manganese (II) salt adsorbed onto a solid inorganic silicon support material, a peroxide compound, an alkali metal carbonate, and optionally a basic inorganic alkaline earth metal salt, wherein the pH of an aqueous solution containing said composition is 11.0 or higher.

17 Claims, No Drawings

BLEACH COMPOSITIONS

BACKGROUND OF THE INVENTION

1. Field of the Invention

The invention relates to a bleah composition and a method utilizing the composition for bleaching surfaces.

2. The Prior Art

Dry bleaching powders, such as those for cleaning laundry, generally contain inorganic persalts as the active component. These persalts serve as sources of hydrogen peroxide. Normally, persalt bleach activity in aqueous solution is undetectable where temperatures are less than 100° F. and delivery dosages less than 100 ppm active oxygen. The art has recognized, however, that bleaching under mild conditions may be effectuated through the use of activators.

Manganese (II) salts have been reported to be exceptionally effective in activating persalts under mild conditions. European Patent Application No. 0 082 563 discloses bleach compositions containing manganese (II) in conjunction with carbonate compounds. British Patent Application No. 82 36,005 describes manganese (II) in conjunction with a condensed phosphate/orthophosphate and an aluminosilicate, the builder combination enhancing bleach performance. European Patent Application No. 0 025 608 reveals peroxide activation catalysts consisting of zeolites or silicates whose cations have been exchanged for heavy metals such as manganese.

The aforementioned compositions still suffer from the presence of soluble manganese (II) ions. The soluble ions deposit on fabrics. Strong oxidants, such as hypochlorites, are frequently included in laundry washes. Deposited manganese will react with strong oxidants to form highly staining manganese dioxide.

U.S. Pat. No. 4,536,183 (Namnath) reports a system which overcomes the staining problem. The patent discloses a bleach activator comprising a water-soluble manganese (II) salt adsorbed onto a solid inorganic silicon support material prepared in such manner as not to contain free manganese (II) ions. Although this system provides adequate bleaching, more potent activators would be desirable where activator must be kept at a low level. Economics, peroxide stability, compatibility and environmental reasons encourage use of activator systems with the highest possible activity.

U.S. Pat. No. 4,208,295 (Sai et al.) discloses bleaching detergent compositions wherein water-insoluble aluminosilicates have had their cations partially exchanged with calcium or magnesium ions. Incorporation of calcium and magnesium was found to improve the storage stability of sodium percarbonate. Evidently, these particular divalent cations were not considered as bleach activators but, rather, as stabilizers to prevent decomposition of peroxide.

Consequently, it is an object of the present invention to provide a bleaching composition based on a supported manganese salt and a persalt that will not result in substrate staining.

A further object of this invention is to provide a bleach composition having exceptionally high activity.

Another object of this invention is to provide a method for improved bleaching of articles such as laundry.

SUMMARY OF THE INVENTION

A bleaching composition is provided which comprises:

(i) from about 1 to 40% of a catalyst comprising a water-soluble manganese (II) salt adsorbed onto a solid inorganic silicon support material, the ratio of manganese (II) salt to support material ranging from 1:1000 to 1:10;

(ii) from about 0.1 to 40% of a peroxide compound;

(iii) from about 0.1 to 50% of an alkali metal carbonate; and (iv) from about 0 to 40% of a basic inorganic alkaline earth metal salt;

the pH of an aqueous solution containing said composition being about 11.0 or higher.

DETAILED DESCRIPTION OF THE INVENTION

Basic alkaline earth metal salts and high pH have each been found to substantially improve the bleaching effectiveness of peroxide compounds activated by manganese (II) salts adsorbed on solid inorganic silicon support materials. The compositions maintain all the desirable features of those reported for supported manganese (II) salt catalysts. These features include avoidance of staining clothing caused by formation of brown manganese dioxide. Staining occurs where manganese (II) ions are in unbound or improperly bound form.

It has been found that a pH of about 11.0 or higher significantly boosts bleach performance for the compositions of this invention. Under appropriate conditions a composition having a pH of 10.8 will also exhibit substantially better performance than one at 10.6 or lower.

In a second aspect, alkaline earth metal salts such as calcium or magnesium hydroxides or oxides have been found to substantially improve bleach activity. An especially preferred salt is calcium hydroxide. This salt may either be added directly or formed in situ from an alkaline hydroxide, e.g. sodium hydroxide, and a calcium salt, e.g. calcium chloride. The basic alkaline earth metal salts are understood in the compositions of this invention as not including any alkaline earth metal ion bound within the silicon support material.

Although calcium hydroxide in high concentration will activate percompounds such as sodium perborate, the combined effects of calcium hydroxide and supported manganese (II) is greater than the expected contribution of either individually. The result is surprising because equivalent concentrations of calcium hardness has been shown to be detrimental to bleaching. Bleaching effectiveness of the calcium/supported manganese/-peroxy system is diminished in hard water. However, it has been found that small amounts of sequestering salts such as tetrasodium pyrophosphate, trisodium polyphosphate and similar builders cancel the detrimental effects of hardness.

Useful amounts of basic alkaline earth metal salts range from about 0.1 to about 40% by weight of the bleaching composition. Preferably, the concentration ranges from about 2 to about 10%. In the wash solution, the basic alkaline earth metal salts should be present from about 100 to 500 parts per million, preferably 100 to 300 ppm.

The manganese used in the present invention can be derived from any manganese (II) salt which delivers mangenous ions in aqueous solution. Manganous sulfate and manganous chloride or complexes thereof such as manganous triacetate are examples of such suitable salts.

The solid inorganic silicon support material has but one requirement—a capacity for manganous (II) adsorption greater than 0.1 weight %. Suitable solid materials encompass the aluminosilicates, including the synthetically formed variety known as zeolites, the silicates, silica gels and aluminas. Among the silicates, magnesium silicate is preferred; this material is sold by the Floridin Corp. under the trademark Florisil TM. Also, preferred are aluminated silicates.

Clays may also be suitable substrates. Two varieties of clay materials which function in the instant composition are geologically known as smectites (or montmorillonoides) and attapulgites (or palygorskites). Smectites are three-layered clays. There are two distinct classes of smectite-type clays. The first contains aluminum oxide, the second has magnesium oxide present in the silicate crystal lattice. General formulas for these smectites are $Al_2(Si_2O_5)_2(OH)_2$ and $Mg_3(Si_2O_5)(OH)_2$, covering the aluminum and magnesium oxide type clays, respectively. Commercially available smectite clays include, for example, montmorillonite (bentonite), volchonskoite, nontronite, beidellite, hectorite, saponite, sauconite and vermiculite. Attapulgites are magnesium-rich clays having principles of superposition of tetrahedral and octahedral unit cell elements different from the smectities. An idealized composition of the attapulgite unit cell is given as: $(OH_2)_4(OH)_2Mg_5Si_8O_{20}.4H_2O$.

Zeolites are the preferred support materials, especially where the composition is intended for laundering clothes. Many commercial zeolites have been specifically designed for use in laundering applications. Accordingly, they exhibit the favorable properties of dispersivity in wash solution. Moreover, their tendency for being entrapped by fabrics is low. Synthetic zeolites, particularly type 4A, are preferred over the natural ones. The latter have an appreciable content of extraneous metal ions that may promote wasteful peroxide decomposition reactions.

Finished catalyst will contain from about 0.1% to about 5.5% manganese (II) ion per weight of solid support. Preferably, the amount of manganese (II) ion is from about 1 to about 2.5%. When the catalyst is placed into the washing liquid, the concentration of manganese (II) ions should range from about 0.5 to 5 ppm of the wash water. Preferably, the manganese ion concentration should range from 0.8 to 2.5 ppm, more preferably 1.2 to 1.8 ppm.

Peroxide compounds are included within the compositions of the present invention. Suitable peroxide compounds include hydrogen peroxide or any of its solid adducts, such as urea peroxide, and the inorganic persalts which liberate hydrogen peroxide in aqueous solution. The latter may be water-soluble perborates, percarbonates, perphosphates, persillicates, persulphates and organic peroxides. Amounts of peroxide compound in the concentrated bleach composition should range from about 0.1 to about 40%. Preferably, the amount may range from about 5 to about 30%.

The composition of the invention may also take the form of a bleach additive product for addition at the point of use either to a wash liquor or to a non-bleaching detergent composition. Under those circumstances, the peroxide compound may be present at even higher levels of up to about 90% by weight of the composition. At least 10 ppm active oxygen, preferably at least 30 ppm, should be delivered by the peroxide to a liter of wash water. For instance, with sodium perborate, this represents a minimum of 200 mg per liter of wash water.

The ratio of active oxygen generated by the peroxide compound to manganese (II) ion in aqueous solution should range from about 1000:1 to 1:1000, preferably 1000:1 to 1:10.

A further important component of the composition is a water-soluble alkali metal carbonate salt. Salts within this definition include sodium, potassium and lithium carbontes. Sodium carbonate is especially preferred. The concentration of this compound should range from about 0.01% to 40%. Preferably, the concentration should range from about 2 to about 10%. In the wash solution, the alkali metal carbonate should be present from about 100 to 300 ppm, preferably 150 to 250 ppm.

The catalyst and compositions of this invention may be applied to hard substrates such as dentures, bathroom tiles and floors. Flexible substrates, specifically laundry, however, will be focused upon in the subsequent discussion.

Phosphate stabilizers are suggested for combination with the bleach composition. Suitable stabilizers include the alkali metal salts of tripolyphosphate, orthophosphates and pyrophosphate. Amounts of phosphate stabilizer should range from about 5% to about 35%. Preferably, they should be present from about 10% to 20%. In aqueous solution, the phosphate stabilizer level should be at least 10 ppm, preferably in the 100 to 200 ppm range. The ratio of stabilizer to peroxy compound should be from about 10:1 to 1:10.

Surface active detergents may be present in an amount from about 2% to 50% by weight, preferably from 5% to 30% by weight. These surface active agents may be anionic, nonionic, zwitterionic, amphoteric, cationic or mixtures thereof.

Among the anionic surfactants are water-soluble salts of alkylbenzene sulfonates, alkyl sulfates, alkyl ether sulfates, dialkyl sulfosuccinates, paraffin sulfonates, $\alpha$-olefin sulfonates, $\alpha$-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and $\beta$-alkoxyalkane sulfonates. Soaps are also preferred anionic surfactants.

Nonionic surfactants are water-soluble compounds produced by the condensation of ethylene oxide with a hydrophobic compound such as a fatty alcohol or fatty acid, alkyl phenol, polypropoxy glycol or polypropoxy ethylene diamine.

Cationic surface active agents include the quaternary ammonium compounds having 1 or 2 hydrophobic groups with 8–20 carbon atoms, e.g., cetyl trimethylammonium bromide or chloride, and dioctadecyl dimethylammonium chloride.

A further exposition of suitable surfactants for the present invention appears in "Surface Active Agents and Detergents", by Schwartz, Perry & Berch (Interscience, 1958), the disclosure of which is incorporated herein by reference.

Detergent builders may be combined with the bleach compositions. Useful builders can include any of the conventional inorganic and organic water-soluble builder salts. Typical of the well known inorganic builders are the sodium and potassium salts of the following: pyrophosphate, tripolyphosphate, orthophosphsate, bicarbonate, silicate, sesquicarbonate, borate and aluminosilicate. Among the organic detergent builders that can be used in the present invention are the sodium and potassium salts of citric acid and nitrilotriacetic acid, the latter being particularly effective. These builders can be used in an amount from 0 up to about 80% by weight of the composition, preferably from 10% to 50% by weight.

Apart from detergent active compounds and builders, compositions of the present invention intended for laundering or cleaning applications can contain all manner of minor additives and in concentrations commonly found in such compositions. Examples of these additives include: lather boosters, such as alkanolamides, particularly the monoethanolamides derived from palm kernel fatty acids and coconut fatty acids; lather depressants, such as alkyl phosphates, waxes and silicones; fabric softening agents; fillers; and usually present in very minor amounts, fabric whitening agents, perfumes, enzymes, germicides and colorants.

The following examples will more fully illustrate the embodiments of the invention. All parts, percentages and proportions referred to herein and in the appended claims are by weight unless otherwise indicated.

EXAMPLES 1–15

Bleaching tests were conducted with a four pot Terg-O-Tometer manufactured by the U.S. Testing Company. Wash solutions were prepared using Edgewater tap water without adjustment. This water has a hardness of approximately 100 ppm expressed as calcium carbonate. Wash temperatures were maintained at 40° C. Wash volumes were one liter.

The procedure involved adding the formulation to the Terg-O-Tometer pot and agitating the solutions for 1 minute. Test cloths were then added and agitation continued for an additional 15 minutes. Thereafter, the pots were drained and the cloths rinsed twice for 1 minute with tap water. Cloths were then dried and evaluated for reflectance.

Bleach activity was determined by measuring the change in reflectance (ΔR) of a dry cotton cloth (4"×6"). Prior to bleaching, the cloth was uniformly stained with a tea soluton and washed several times in a commercial detergent. Reflectance was measured on a Gardner XL-23 reflector.

In most of the following experiments, the oxygen bleach additive combination of this invention was added alongside a regular commercial detergent. To simulate phosphate type detergents, Tide®, a product of the Proctor & Gamble Company, was employed as the base detergent at a concentration of 1.3 grams per liter (manufacturers recommended dose). Experiments were also run with a non-phosphate commercial formulation known as Concentrated "all"® produced by Lever Brothers Company and employed in the amount of 1.8 grams per liter. Each detergent was placed in the Terg-O-Tometer prior to the addition of the bleach additive combination and before agitation was begun. Thereafter, the bleach additive was charged to the Terg-O-Tometer pot. Their concentrations are listed in Table I as actual wash concentrations.

Catalysts were prepared in the following manner: a solution of manganous choride was added to a slurry of zeolite 4A, a sodium aluminosilicate, which has had its pH adjusted to about 10. The slurry was dried and agglomerated into detergent-powder sized granules with either polvinyl pyrrolidone (PVP) or carboxymethylcellulose gum. These slurries were then spray dried. Other additives could also be co-spray dried with the catalyst granule.

Manganese levels are reported in Table I as ppm of manganese ion. Thus, 120 ppm of 1% manganese on zeolite would, for example, give a level of 1.2 ppm manganese ion.

PB1 in Table I refers to sodium perborate monohydrate, the source for active oxygen in the bleaching system. "Neodol" refers to Neodol 45–31 TM, a nonionic detergent, sold by the Shell Chemical Company. This surfactant is a $C_{14}$–$C_{15}$ alcohol ethoxylated with an average of 13 moles ethylene oxide.

Examples 1 to 15 show the effects of various components of the invention on bleaching efficiency.

TABLE I

| | | | Detergent: Concentrated "all" ® Manganese Catalyst: 1% on zeolite | | | | | |
|---|---|---|---|---|---|---|---|---|
| Example | pH | Mn | PBl | $Na_2CO_3$ | $Ca(OH)_2$ | Neodol | Hardness | ΔRd |
| 1 | 10.2 | | | No additive | | | 100 | −3.5 |
| 2 | NR | — | — | — | 200 | — | 100 | −2.2 |
| 3 | NR | — | 300 | — | — | — | 100 | −2.2 |
| 4 | NR | 1.2 | — | — | — | — | 100 | −2.8 |
| 5 | NR | — | — | 300 | — | — | 100 | −2.6 |
| 6 | NR | — | 300 | 300 | — | — | 100 | +2.9 |
| 7 | NR | 1.2 | — | — | 200 | — | 100 | −1.6 |
| 8 | 11.0 | 1.2 | 300 | 200 | 200 | 50 | 100 | +21.3 |
| 9 | 10.6 | 1.2 | 300 | 200 | 200 | 50 | 100 | +6.2 |
| 10 | 11.0 | — | 300 | 200 | 200 | 50 | 100 | +4.4 |
| 11 | 10.6 | — | 300 | 200 | 200 | 50 | 100 | −0.1 |
| 12 | 11.0 | 1.2 | 300 | 200 | — | 50 | 100 | +15.8 |
| 13 | 10.6 | 1.2 | 300 | 200 | — | 50 | 100 | +5.7 |
| 14 | 11.0 | 1.2 | 300 | 200 | — | 50 | 300 | +2.8 |
| 15 | 10.6 | 1.2 | 300 | 200 | — | 50 | 300 | +1.1 |

Example 1 shows the effect of a detergent, Concentrated "all"®, in the absence of other additives. In the presence of alkalinity, the tea stained test cloth actually darkened, the ΔRd was −3.5. This example is considered as the reference composition and reflectance value.

Examples 2 through 7 show the effect of the individual components. In the absence of perborate, bleaching is negligible. Perborate, in the absence of manganese or calcium hydroxide provides only minimal bleaching.

Examples 8 through 15 illustrate the activation of perborate in the presence of calcium hydroxide and magnanese. The addition of calcium hydroxide to a sodium carbonate solution raises pH. It was, thus, necessary in evaluating the effect of other components to isolate the pH variable. Example 8, with calcium hydroxide and sodium carbonate, had an unadjusted pH of 11.0. Example 13, without calcium hydroxide, had an unadjusted pH of 10.6. The pH levels in Examples 8–15 were adjusted to either 11.0 or 10.6 using sodium hydroxide or sulfuric acid.

A comparison of Examples 8 and 9 demonstrates the dramatic effect of pH. Bleaching is decreased from ΔRDL32 21.3 to 6.2, or 15.1 units, by decreasing pH from 11.0 to 10.6. Example 12, at the higher pH but absent calcium hydroxide, exhibits a notable drop in performance. The bleaching effect is 15.8 units, or 5.5 units less than in Example 8 where calcium hydroxide is present.

Example 11 demonstrates that calcium hydroxide at the lower pH is ineffective in the absence of manganese catalyst. At the higher pH, illustrated by Example 10, effectiveness improves. Example 12 shows the value of manganese (15. 8 units) at the higher pH, even in the absence of calcium hydroxide.

Example 12, at the higher pH, with manganese but absent calcium hydroxide, provides an increase relative to Example 13 of 10.1 units in performance, i.e. from 5.7 up to 15.8. Addition of calcium hydroxide, as in Example 8, provides a 15.3 unit bleaching difference. This clearly shows the desirability of using calcium hydroxide in this oxygen bleach system.

Examples 14 and 15 were designed to determine if water hardness (calcium and magnesium ions) affects bleach activity. We would expect 16 units with manganese and 21 units with manganese-calcium hydroxide. Surprisingly, the ΔRd was only 2.8 and 1.1. units at the 11.0 and 10.6 pH level, respectively, in the absence of calcium hydroxide. This demonstrates water hardness to be detrimental to bleaching when using a non-phosphate detergent such as Concentrated "all" ®. This detergent contains a nonionic surfactant, sodium carbonate (builder) and sodium silicate (alkalinity promoter).

EXAMPLES 16–24

The following examples illustrate the invention using Tide ®, a phosphate containing commercial detergent. Tide ® contains anionic surfactants, sodium tripolyphosphate and sodium carbonate as builders alongside sodium silicate.

TABLE II

| | | Detergent: Tide ® Manganese Content: 1% on Aluminosilicate | | | | | | |
|---|---|---|---|---|---|---|---|---|
| Example | pH | Mn | PBl | $Na_2CO_3$ | $Ca(OH)_2$ | Neodol | Hardness | ΔRd |
| 16 | 10.0 | | | No additive | | | 100 | −4.7 |
| 17 | 11.0 | 1.2 | 300 | 200 | 200 | 50 | 100 | +15.5 |
| 18 | 10.5 | 1.2 | 300 | 200 | 200 | 50 | 100 | +2.1 |
| 19 | 11.0 | — | 300 | 200 | 200 | 50 | 100 | +4.9 |
| 20 | 10.5 | — | 300 | 200 | 200 | 50 | 100 | +1.2 |
| 21 | 11.0 | 1.2 | 300 | 200 | 0 | 50 | 100 | +5.5 |
| 22 | 10.5 | 1.2 | 300 | 200 | 0 | 50 | 100 | +2.5 |
| 23 | 11.0 | 1.2 | 300 | 200 | 0 | 50 | 300 | +14.1 |
| 24 | 10.5 | 1.2 | 300 | 200 | 0 | 50 | 300 | +9.7 |

Example 16 reveals that Tide ®, with no additive, has a bleaching effect of minus 4.7 units. Examples 17 and 18 compares the pH influence on a formula containing calcium hydroxide and manganese. A 0.5 increase in pH boosts bleaching by 13.4 units, i.e. from 2.1 to 15.5. For comparison, Example 21, which contains manganese in soft water but no calcium hydroxide, exhibits a ΔRd of only +5.5 units. Examples 23 and 24, in which the calcium ions are provided by hardness, exhibit bleaching values of 14.1 and 9.7 at the high and low pH, respectively. These experiments show the need for calcium and maganese ions in the bleach system.

Examples 19 and 20 contain calcium hydroxide but no manganese. Examples 21 and 22 contain manganese but no calcium hydroxide. Bleach results are essentially equivalent at equal pH. Performance for Examples 19–22 is mediocre when compared to run 17. Again, these results show the need for calcium in the system.

EXAMPLES 25–47

The poor performance of non-phosphate detergents in the presence of high hardness can be largely overcome by the addition of phosphates to the bleach composition; e.g., trisodium orthophosphate (TSOP), tetrasodium pyrophosphate (TSPP) and pentasodium tripolyphosphate (TPP). Effects of phosphate, water hardness and different Mn catalyst levels are detailed in Examples 25–36.

TABLE III

| | | Manganese Content: 1% or 1.25% of catalyst | | | | | | | |
|---|---|---|---|---|---|---|---|---|---|
| Example | TSPP | Mn | PBl | $Na_2CO_3$ | $Ca(OH)_2$ | Neodol | Hardness | Detergent | ΔRd |
| 25 | 100 | 1.8 | 300 | 230 | 200 | 50 | 100 | Tide | 14.6 |
| 26 | 100 | 1.8 | 300 | 230 | 200 | 50 | 200 | Tide | 13.3 |
| 27 | 100 | 1.8 | 300 | 230 | 200 | 50 | 100 | "all" | 18.5 |
| 28 | 100 | 1.8 | 300 | 230 | 200 | 50 | 200 | "all" | 9.4 |
| 29 | 200 | 1.2 | 300 | 300 | 200 | — | 100 | "all" | 9.0 |
| 30 | — | 1.2 | 300 | 300 | 200 | 50 | 100 | Tide | 15.6 |
| 31 | 200 | 1.2 | 300 | 300 | 200 | — | 100 | Tide | 4.1 |
| 32 | — | 1.2 | 300 | 300 | 200 | 50 | 100 | Tide | 4.6 |
| 33 | — | 1.8 | 300 | 330 | 200 | 50 | 100 | Tide | 16.0 |
| 34 | — | 1.8 | 300 | 330 | 200 | 50 | 200 | Tide | 12.5 |
| 35 | — | 1.8 | 300 | 330 | 200 | 50 | 100 | "all" | 17.1 |
| 36 | — | 1.8 | 300 | 330 | 200 | 50 | 200 | "all" | 6.6 |
| 37 | — | 1.5 | 300 | 330 | 200 | 50 | 300 | Tide | 3.6 |
| 38 | — | 1.5 | 300 | 330 | 200 | 50 | 300 | "all" | 3.7 |
| 39 | — | 1.5 | 300 | 330 | 200 | 50 | 100 | Tide | 8.5 |
| 40 | — | 1.5 | 300 | 330 | 200 | 50 | 100 | "all" | 20.9 |
| 41 | 100 | 1.5 | 300 | 330 | 200 | 50 | 300 | "all" | 6.7 |
| 42 | (1) | 1.5 | 300 | 330 | 200 | 50 | 300 | "all" | 6.7 |
| 43 | (2) | 1.5 | 300 | 330 | 200 | 50 | 300 | "all" | 5.8 |

TABLE III-continued

| Example | TSPP | Mn | PBl | $Na_2CO_3$ | $Ca(OH)_2$ | Neodol | Hardness | Detergent | ΔRd |
|---|---|---|---|---|---|---|---|---|---|
| | | Manganese Content: 1% or 1.25% of catalyst | | | | | | | |
| 44 | 100 | 1.5 | 300 | 330 | 200 | 50 | 300 | Tide | 12.5 |
| 45 | (1) | 1.5 | 300 | 330 | 200 | 50 | 300 | Tide | 4.2 |
| 46 | (2) | 1.5 | 300 | 330 | 200 | 50 | 300 | Tide | 11.1 |
| 47 | — | 1.5 | 300 | 330 | $Mg(OH)_2$ | 50 | 100 | "all" | 10.2 |

(1)100 mg/l penta sodium tripolyphosphate $Na_5P_3O_{10}$
(2)100 mg/l trisodium orthophosphate $Na_3PO_4$ The additive composition of Example 35 produces a ΔRd of 17.1 in 100 ppm hardened water. By contrast, Example 36 provides only a 6.6 ΔRd value in 200 ppm hardened water. The bleaching effect is increased to 9.4 by addition of 100 ppm of pyrophosphate in 200 ppm hardness (Example 28). ΔRd is 18.5 for the Example 27 formula identical to Example 28 but containing 100 ppm more hardness.

Examples 37–40 show that high hardness (300 ppm) is detrimental to bleaching. However, bleaching performance may be substantially restored by addition of phosphate (Examples 41 to 46). These latter examples also show that polyphosphate, pyrophosphate, and orthophosphate are substantially equivalent in efficiency.

In Example 47, magnesium hydroxide was substituted for an equal weight of calcium hydroxide. The ΔRd, 10.2, is somewhat less than would be obtained from calcium hydroxide but more than if the calcium or magnesium were eliminated (Example 13). This shows magnesium promotes bleaching.

EXAMPLES 48–52

Effectiveness as a Pre-Wash Soak-Bleach

Various formulations were used as a bleaching soak. The test consisted of agitating the detergent, if any, the bleach, and the test cloths, for 2 minutes, and then soaking without agitation for various times. These formulations were found superior to a commercially sold oxygen bleach.

TABLE IV

| Example | Detergent | PBl | $Na_2CO_3$ | $Ca(OH)_2$ | Neodol | Mn | Hardness | Time | ΔRd |
|---|---|---|---|---|---|---|---|---|---|
| 48 | None | 300 | 330 | 200 | 50 | 1.8 | 100 | 15 min. | −1.6 |
| 49 | None | 300 | 330 | 200 | 50 | 1.8 | 100 | 30 min. | +3.7 |
| 50 | None | 300 | 330 | 200 | 50 | 1.8 | 100 | 60 min. | +4.5 |
| 51 | None | 300 | 330 | 200 | 50 | 1.5 | 100 | 60 min. | +7.1 |
| 52* | None | 210 | 260 | — | — | — | 100 | 30 min. | −0.6 |

*Commercially sold oxygen bleach

EXAMPLE 53

Use as a Spot Remover

A tea stained cloth was wet in water and laid flat on a tray. Approximately 5 grams of bleach additive power of the formula used in Example 48 was placed in the center of the cloth and allowed to set undisturbed. After 5 minutes, the cloth was rinsed. Nearly all the stain was removed in the area of the bleach.

EXAMPLES 54–57

Illustrations of typical bleach additive and detergent containing bleach additive formulations are provided in Table V, by Examples 54–55 and 56–57, respectively. Examples 54, 55 and 56–57 are intended for use at 1, 1.2 and 1.5 grams/liter, respectively.

TABLE V

| Component (wt. %) | Formulations Example 54 | 55 | 56 | 57 |
|---|---|---|---|---|
| Manganese/Zeolite Catalyst | 12 | 10 | 8 | 8 |
| Sodium Carbonate | 33 | 27.5 | 37.9 | 24.6 |
| Calcium Hydroxide | 20 | 16.6 | 13.3 | 13.3 |
| Sodium Tripolyphosphate | — | 16.6 | — | 13.3 |
| Sodium Perborate | 30 | 25 | 20 | 20 |
| Neodol 45–13 | 5.0 | 4.3 | 11.3 | 11.3 |
| Sodium Silicate | — | — | 6.6 | 6.0 |
| Water and Miscellaneous | — | — | 2.9 | 2.9 |

The foregoing description and examples illustrate selected embodiments of the present invention and in light thereof variations and modifications will be suggested to one skilled in the art, all of which are in the spirit and purview of this invention.

What is claimed is:

1. A bleaching composition comprising:

(i) from about 1 to 40% of a catalyst comprising a water-soluble manganese (II) salt adsorbed onto a water-insoluble solid inorganic silicon support material, the ratio of manganese (II) salt to support material ranging from 1:1000 to 1:10;

(ii) from about 0.1 to 40% of a peroxide compound;

(iii) from about 0.1 to 50% of an alkali metal carbonate; and (iv) from about 0.1 to 40% of calcium hydroxide; the pH of an aqueous solution containing said composition being 11.0 or higher.

2. A bleaching composition according to claim 1 wherein calcium hydroxide is present from 2 to 25% by weight.

3. A bleaching composition according to claim 1 wherein is formed in situ from an alkaline metal hydroxide and a calcium salt.

4. A bleaching composition according to claim 3 wherein the alkaline metal hydroxide is sodium hydroxide and the calcium salt is a calcium halide, sulphate or nitrate.

5. A bleaching composition according to claim 1 wherein the alkali metal carbonate is sodium carbonate.

6. A bleaching composition according to claim 1 wherein the peroxide compound is sodium perborate.

7. A bleaching composition according to claim 1 wherein the peroxide compound is selected from the group consisting of hydrogen peroxide, organic peroxides and the inorganic salts of percarbonates, perphosphates, persilicates and persulphates.

8. A bleaching composition according to claim 1 further comprising from about 5% to about 35% of an inorganic phosphate.

9. A bleaching composition according to claim 8 wherein the inorganic phosphate is selected from the group consisting of salts of polyphosphate, pyrophosphate, orthophosphate and mixtures thereof.

10. A bleaching composition according to claim 1 further comprising from about 2% to 50% of a surface active compound.

11. A bleaching composition according to claim 10 wherein the surface active comound is selected from the group consisting of anionic, nonionic, zwitterionic, amphoteric, cationic compounds or mixtures thereof.

12. A bleaching composition according to claim 1 wherein the solid inorganic silicon support material is a zeolite.

13. A bleaching composition according to claim 1 wherein the solid inorganic silicon support material is selected from the group consisting of magnesium silicate, aluminated silicates, silica gels, aluminas, clays and mixtures thereof.

14. A bleaching composition according to claim 1 further comprising from 0 to 80% of a builder salt.

15. A bleaching composition according to claim 14 wherein the builder is a sodium or potassium salt selected from the group consisting of carbonate, bicarbonate, silicate, sesquicarbonate, borate, aluminosilicate, citrate, nitrilotriacetate and mixtures thereof.

16. An aqueous bleaching composition comprising:

(i) a catalyst comprising a water-soluble manganese (II) salt absorbed onto a water-insoluble solid inorganic silicon support material in a ratio ranging from about 1000:1 to 1:1000, the concentration of manganese (II) ions ranging from about 0.5 to 5 ppm per liter of wash water;

(ii) a peroxide compound in an amount to deliver at least 30 ppm active oxygen per liter of wash water;

(iii) an alkali metal carbonate in an amount from about 10 to about 1000 ppm per liter of wash water;

(iv) calcium ions derived from calcium hydroxide from about 100 to about 1000 ppm per liter of wash water; and the pH of the aqueous solution being 11.0 or higher.

17. A method for bleaching fabric substrates comprising placing the substrate into water and treating with a composition to be added to said water comprising:

(i) from about 1 to 40% of a catalyst comprising a water-soluble manganese (II) salt adsorbed onto a water-insoluble solid inorganic silicon support material, the ratio of manganese (II) salt to support material ranging from 1:1000 to 1:10;

(ii) from about 0.1 to 40% of a peroxide compound;

(iii) from about 0.1 to 50% of an alkali metal carbonate; and (iv) from about 0.1 to 40% of calcium hydroxide; the pH of an aqueous solution containing said composition being 11.0 or higher.

* * * * *